US006595632B1

(12) United States Patent
Storfer-Isser et al.

(10) Patent No.: US 6,595,632 B1
(45) Date of Patent: Jul. 22, 2003

(54) INK-JET PRINTABLE VINYL FILMS WITH IMPROVED CURL PROPERTIES

(75) Inventors: Nathan I. Storfer-Isser, Liverpool, NY (US); James A. Nellis, Phelps, NY (US)

(73) Assignee: Felix Schoeller Technical Papers, Inc., Pulaski, NY (US)

( * ) Notice: Subject to any disclaimer, the term of this patent is extended or adjusted under 35 U.S.C. 154(b) by 0 days.

(21) Appl. No.: 10/084,525

(22) Filed: Feb. 25, 2002

(51) Int. Cl.[7] ..... B41J 2/01
(52) U.S. Cl. ..... 347/105; 428/195
(58) Field of Search ..... 347/105, 106, 347/101, 95, 84; 428/195, 187, 189, 143, 364, 153, 98, 103; 346/158

(56) References Cited

U.S. PATENT DOCUMENTS 5,601,927 A * 2/1997 Plourde ..... 347/105
5,747,148 A * 5/1998 Warner et al. ..... 347/105
5,888,615 A * 3/1999 Mascarenhas et al. ..... 428/195
6,436,604 B1 * 8/2002 Bourdelais et al. ..... 430/256
6,497,998 B1 * 12/2002 Dontula et al. ..... 347/106

FOREIGN PATENT DOCUMENTS

JP 54004135 A * 1/1979 ..... G03G/7/00

* cited by examiner

*Primary Examiner*—Judy Nguyen
*Assistant Examiner*—Manish Shah
(74) *Attorney, Agent, or Firm*—Amster, Rothstein & Ebenstein

(57) ABSTRACT

An ink-jet printable static cling film including a support, a vinyl film, a curl avoiding polymer layer and a dye-receiving layer, said curl-avoiding polymer layer provides a stiffness (100% modulus) according to ASTM D412-98*a* of from about 9 to about 34 MPa and a percent (%) elongation according to ASTM D2370-82 of about 250 to 400%.

6 Claims, No Drawings

INK-JET PRINTABLE VINYL FILMS WITH IMPROVED CURL PROPERTIES

TECHNICAL FIELD OF THE INVENTION

The invention relates to an ink-jet printable static cling film with improved curl properties which is applied on a support without the requirement of an adhesion layer to be used in advertising and graphic displays.

BACKGROUND OF THE INVENTION

For the purpose of advertising and graphic displays two kinds of polymer films are known. There are the self adhesive films with an adhesive coating. These films require a support provided with a release liner. In contrast, so-called static cling films have no adhesive coating. These films require the support to have a smooth surface and are applied using low pressure on the permanent support.

Polymer films for static cling films are typically PVC films (vinyl films) and are used for the decoration of windows, metal surfaces and other smooth objects. For the manufacture, transport, and storage of static cling films a support is required. Suited for this purpose are, for example, pigmented and unpigmented films or resin coated papers. The support must have a smooth surface in order to provide good adhesion to the vinyl film. However, the adhesion should not be to strong in order to avoid a deformation of the film during release of the film from the support.

A suitable support paper is coated with a pigment-containing layer and is dried by contact with a hot, highly glossy cylinder. This contact results in a support with a glossy surface. Further, extrusion coated papers are also appropriate for this purpose. The polymer which is to be extruded on the paper is most often a polyolefin. Treating the extrusion coated paper with a chill roll results in highly glossy surfaces.

U.S. Pat. No. 5,601,927 discloses a printable static cling material having a polypropylene film or a polyethylene-terephthalate film arranged between the so-called cling film and the recording layer. As an elastomeric material for the cling film a polymer on the basis of silicon or polyurethane is suggested. The support is a film of a resin coated paper. Disadvantageous with that material is the occurrence of curl resulting in a delamination from the permanent support. Other disadvantages include cost of applying the PET or PP layer as well as reduced transparency caused by the adhesive used in the capping operation.

SUMMARY OF THE INVENTION

It is the objective of the invention to provide a printable vinyl film having a low tendency towards the formation of curl, excellent aging resistance, and high image quality.

This objective is achieved with a static cling material comprising a paper coated with a thermoplastic resin, a vinyl film arranged on at least one surface of the coated paper and at least one curl avoiding polymer layer and a dye receiving layer. The curl avoiding layer itself shows a negative curl.

Said curl-avoiding polymer layer according to the invention provides a stiffness (100% modulus) according to ASTM D412-98 of from about 9 to about 34 MPa and a percent(%) elongation according to ASTM D2370-82 of about 250 to 400%.

DETAILED DESCRIPTION OF THE INVENTION

The stiffness (100% modulus) according to ASTM D412-98a required for the non-curling properties ranges from about 9 MPa to less than about 34 MPa, preferably 9.5 to 30 MPa. It should be considered that the given ranges may vary slightly in dependence of the temperature of the curl-avoiding layer.

The percent(%) elongation necessary for the compensation of curl in the material of the invention is about 250 to 400%, preferably 270 to 325% according to ASTM D2370-82. Accordingly, the percent elongation was determined by casting films of roughly 2 mils dry, air drying them, oven curing them 3 minutes at 300° F., equilibrating the films overnight at room conditions (about 70° F. and 50% RH), running 1" wide films, using a jaw gap of either 1 inch (for high elongation films) or 2 inches (typical standard) and using an elongation rate of 2" per minute.

Surprisingly, it was found that the acid number of the polymer used for the curl-avoiding layer has an important influence on the curl behavior. In the present invention the term acid number refers to the degree of substitution on the polymer chain, i.e. the number and lengths of the side chains present. The acid number may be greater than about 18, preferably more than about 20. The acid number may be determined according to ASTM D4662-98.

Finally, it was found that the viscosity of the polymer dispersion used for the preparation of the curl-avoiding layer does have a certain influence on the non-curling properties of this layer. For the purposes of the present invention the dynamic viscosity of said polymer dispersion should be 25 to 100 at 12 RPM, 25° C., LV-1.

It was found that certain kinds of polyurethane polymers are particularly preferred. These polymers are waterborne aliphatic polyurethanes. The aliphatic polyurethane may also be a cationic modified polyurethane resin. Particularly preferred is an aliphatic polyurethane the film of which provides a tensile strength of from 42 to 45 MPa, particularly about 44 MPa. The acid number of such a polymer is about 20 to 23. Preferably such a polymer is used in the form of a dispersion. The dispersion may preferably have a viscosity of about 95 to 105 cps. The solids content of the dispersion may amount to 32 to 38%, for example about 35% by weight.

To further control the adhesion or release properties of the vinyl film on which the curl-avoiding layer is applied pigments such as titanium dioxide, calcium carbonate, alumina and/or silica may be added to the polymer dispersion which forms said layer. The particle size of the pigments is in the range of about 0.1 to 1000 nm, preferably between 1 and 500 nm. The pigment which is particularly preferred is a colloidal silica. The pigment content in the layer should not be more than about 40% by weight, preferably in the range of about 5 to 20% by weight. For clear substrates, no pigment is added to the curl avoiding layer.

The curl-avoiding layer composition can be applied using all conventional coating and metering processes, such as roller coating, engraving or nip processes and air brushing or bleed knife metering. The coating weight may amount to about 4 to 20 g/m$^2$, preferably 6 to 12 g/m$^2$.

If a dye-receiving layer should be used its composition, may be a composition known in the art for this purpose. If a transparent substrate is used also the dye-receiving layer must be transparent. However, to support the curl-avoiding layer, the dye-receiving layer should provide similar properties as the curl-avoiding polymer layer, i.e. similar stiffness (100% modulus) and a similar elongation. Thus, the dye-receiving layer should provide a negative curl as does the curl-avoiding layer.

The dye receiving layer may be glossy, for example 60°, preferably more than 75° and most preferably more than 90°. The curl avoiding layer preferably should also be glossy.

The desired anti-curl properties could be controlled by adjusting the thickness of the curl-avoiding layer and the coating weight of the dye-receiving layer. According to a preferred embodiment of the invention the coating weight of the dye-receiving layer is selected to support the negative curl properties of the curl-avoiding polymer layer. Thus, the dye-receiving layer itself may have a negative curl. Most preferably, the coating weight should be kept at low values. For example, the coating weight of the dye-receiving layer could be to 3 to 20 g/m$^2$, preferably 5 to 10 g/m$^2$.

According to a further embodiment of the invention an ink-absorbing layer can be arranged between the dye-receiving layer and the support. The coating weight of the ink-absorbing layer may amount to 5 to 30 g/m$^2$, preferably 7 to 12 g/m$^2$. The ink-absorbing preferably has the same curl properties, clarity and gloss such as the curl-avoiding layer. Composition of the ink-absorbing layers are known in the art. They include a binder and pigments with high absorption capacities such as silica and alumina. The binder could be any binder used in the field of-ink-jet printing, such as polyvinylalcohol, polyvinyl pyrrolidone or mixtures thereof.

The support material for the purposes of the invention may include raw paper or a base paper which is composed of a raw paper and a thermoplastic polymer layer applied on the raw paper. The basis weight of the raw paper is from 20 to 250 g/m$^2$, in particular of from about 50 to 200 g/m$^2$, for example 110 to 160 g/m$^2$. All the varieties of cellulosic fibers and synthetic fibers are suitable for producing the raw paper. Soft wood pulp and hard wood pulp, pulped by alkaline or acetic methods may be used. All the sizing agents and wet strength agents known in the paper industry may be used for sizing.

Preferably, the paper is sized with a neutral or alkaline sizing agent. The paper may contain additional additives such as dyes. The paper can also be a surface sized paper.

The thermoplastic resin for providing the resin layer onto the raw paper is a polyolefin such as a polyethylene, polypropylene, polymethyl pentene and polybutylene and copolymers of two or more olefins or blends thereof suitable for extrusion. Particularly suitable are all types of polyethylene such as high-density polyethylene (HDPE), low density polyethylene (LDPE), linear low-density polyethylene (LLDPE) and blends thereof. Further suited as thermoplastic resins are polyesters, polycarbonates, polyurethanes, polyamides or polyvinyl alcohol.

The thermoplastic resin preferably is applied by extrusion coating. To obtain a high degree of smoothness a highly glossy chill roll is used for the extrusion coating.

Preferably the roughness Rz of the resin surface should not exceed a value of about 2.0 $\mu$m. According to a particular preferred embodiment of the invention the roughness Rz is between 0.9 to 1.8 $\mu$m.

The coating weight of the resin layer which is applied onto the raw paper is from about 10 to 50 g/m$^2$, in particular up to about 35 g/m$^2$.

The vinyl films used for the purposes of the present invention are those vinyl films which are known and already used in the art.

The following examples shall further explain the invention.

EXAMPLE 1

A raw paper, comprising 31 wt % soft wood pulp and 69%wt hard wood pulp is neutrally sized. This raw paper had a basis weight of 152 g/m$^2$ and a thickness of 155 $\mu$m. Low density polyethylene (0.915 g/cm$^3$) was applied onto the raw paper by means of melt extrusion. The coating weight was 25 g/m$^2$. During extrusion the laminate was treated with a highly glossy chill roll to obtain good adhesion of the vinyl film on the raw paper to obtain a base paper.

EXAMPLE 1a

A polyvinyl chloride film of a thickness of 200 $\mu$m was coated with a polyurethane emulsion (Sancureg 2725) as the so-called curl avoiding layer. The polyurethane layer had a stiffness (100% modulus) of 25.51 and an elongation of 270%. The coating weight of the polyurethane emulsion was 8 g/m$^2$.

An ink-recording layer composition consisting of a polyurethane emulsion (Patelacol®) IJ-70) was coated onto the polyurethane curl-avoiding layer with a coating weight of 8 g/m$^2$.

EXAMPLE 1b

Similar to example 1a whereas the coating weight of the curl-avoiding layer is 8 g/m$^2$.

EXAMPLE 1c

Similar to example 1a whereas the coating weight of the curl-avoiding layer is 10 g/m$^2$.

EXAMPLE 2 (Comparative Example)

Onto the vinyl film of example 1a only the ink-recording layer of example 1a was coated. No curl-avoiding layer is present in the comparative sample.

All the aforementioned coating weights refer to the dried layer. The compound films of examples 1a to 1c and the comparative example were then laminated onto the base paper of example 1.

Subsequently, the assessment of adhesion and curl was performed by visual determination of the height of the edges by means of a caliper gauge. The results are indicated in table 1.

TABLE 1

| Sample | Curl | Curl*1 | Adhesion | Adhesion*2 | Adhesion*3 |
|---|---|---|---|---|---|
| Example 1a | 0.0 | 0.0 | 1 | 14 | 1 |
| Example 1b | 0.0 | 0.5 | 1 | 1 | 1.5 |
| Example 1c | 0.0 | 0.5 | 1 | 1 | 1.5 |
| Comp. Example | 9.5 | 18.5 | 1.5 | 2.5 | 4.5 |

*1assessment 2 days after preparation,
*2assessment 1 week after preparation,
*3assessment 4 weeks after preparation.

The results show that even after a longer period of time the non-curling layer of the invention provides good anti-curling properties as well as good adhesion properties on the vinyl film.

EXAMPLE 3

An assessment of the curling behaviour of several static cling films have been performed. For the curl avoiding layer different polyurethane emulsions have been tested. Their viscosity, 100% stiffness modulus, % elongation, hardness of the formed film and acid number of the polymer are indicated in table 2 below.

TABLE 2

| Sancure ® grade | Viscosity | 100% Modulus | % Elongation | Hardness | Acid-number |
|---|---|---|---|---|---|
| 825 | 425 | 33.09 | 200 | 34 | 19.8 |
| 898 | 200 | 35.34 | 300 | 48 | 35.3 |
| 899 | 700 | 20.68 | 300 | 38 | 24.2 |
| 1601 | 1,500 | 2.76 | 550 | 32 | 21.7 |
| 2715 | 750 | 7.57 | 425 | 14 | 17.7 |
| 2720 | 100 | 10.34 | 450 | 26 | 19.2 |
| 2725 | 100 | 25.51 | 270 | 34 | 21.6 |

Samples of different composition of the curl-avoiding layer which include one of the polyurethane resins indicated in table 2 were coated, printed, and applied to a window. Samples that remained on the window for at least six weeks with no delamination and which still had excellent clarity and good light-fastness were considered successful.

In spite of the fact that all of the tested polymers are waterborne polyurethane polymers it was surprising that only the Sancure® grade 2725 shows the required curl avoiding properties.

We claim:

1. An ink-jet printable static cling film comprising a support, a vinyl film, a curl avoiding polymer layer and a dye-receiving layer, said curl-avoiding polymer layer provides a stiffness (100% modulus) according to ASTM D412-98a of from about 9 to about 34 MPa and a percent (%) elongation according to ASTM D2370-82 of about 250 to 400%, where the curl-avoiding polymer layer is prepared from a polymer dispersion having a dynamic viscosity of 25 to 105 cps at 12 RPM. 25° C., LV-1.

2. An ink-jet printable static cling film according to claim 1 wherein said curl-avoiding polymer layer provides a stiffness (100% modulus) according to ASTM D412-98a of from about 9.5 to about 30 MPa.

3. An ink-jet printable static cling film according to claim 1 wherein the percent elongation according to ASTM D2370-82 of about 270 to 325%.

4. An ink-jet printable static cling film according to claim 2 wherein the percent elongation according to ASTM D2370-82 of about 270 to 325%.

5. An ink-jet printable static cling film according to claim 1 wherein curl-avoiding polymer layer has an acid number of at least about 18.

6. An ink-jet printable static cling film according to claim 1 wherein the polymer of the curl-avoiding layer consists of the same monomers as the binder polymer of the dye-receiving layer.

* * * * *